United States Patent [19]

Jenkins et al.

[11] Patent Number: 4,634,622

[45] Date of Patent: Jan. 6, 1987

[54] LIGHTWEIGHT ASPHALT BASED BUILDING MATERIALS AND PROCESS FOR MAKING SAME

[75] Inventors: Kenneth L. Jenkins, Littleton; Stanley C. Suhaka, Englewood; Rick L. Dolin, Littleton, all of Colo.; Allan R. LaRoche, Lewiston, Me.; Robert E. Hodgson, Littleton, Colo.; Neil R. Such, Englewood, Colo.; Douglas D. Smith, Highlands Ranch, Colo.; Frank R. Newton; Richard N. Cunningham, both of Littleton, Colo.

[73] Assignee: Manville Corporation, Denver, Colo.

[21] Appl. No.: 776,252

[22] Filed: Sep. 16, 1985

Related U.S. Application Data

[63] Continuation-in-part of Ser. No. 669,202, Jan. 24, 1985, abandoned, which is a continuation-in-part of Ser. No. 615,183, May 30, 1984, abandoned.

[51] Int. Cl.[4] ..... B32B 11/02; B32B 11/10; B05D 1/12

[52] U.S. Cl. ..... 428/143; 427/186; 427/187; 427/202; 427/398.1; 428/291; 428/323; 428/331; 428/489

[58] Field of Search ..... 428/141, 143, 144, 291, 428/489, 323, 331; 106/281 R, DIG. 2; 156/71; 427/186, 187, 398.1, 202

[56] References Cited

U.S. PATENT DOCUMENTS

| | | | |
|---|---|---|---|
| 3,138,897 | 6/1964 | McCorkle | 427/186 |
| 3,561,334 | 2/1971 | Gerosa et al. | 106/122 |
| 4,168,179 | 9/1979 | Hesseler | 106/281 R |
| 4,183,980 | 1/1980 | Nielson | 427/215 |

FOREIGN PATENT DOCUMENTS 1440309 6/1976 United Kingdom .

OTHER PUBLICATIONS

*Nonmetallic Minerals,* Labdo, McGraw-Hill Book Co. Inc., Second Edition, 1951, pp. 407–415.

*Primary Examiner*—Paul J. Thibodeau
*Attorney, Agent, or Firm*—John D. Lister; Cornelius P. Quinn; Timothy R. Schulte

[57] ABSTRACT

A lightweight asphalt roofing product wherein the asphalt-based coating has a specific gravity less than 1.0. A lightweight filler is used which has an effective specific gravity in the range of 0.10–0.50 and is present in the coating in the range of 3%–25% by weight of the filled coating. In a preferred embodiment, the filler particles have hollow, gas filled inclusions, and comprise expanded perlite particles or expanded permicite particles.

19 Claims, 3 Drawing Figures

LIGHTWEIGHT ASPHALT BASED BUILDING MATERIALS AND PROCESS FOR MAKING SAME

This Application is a continuation-in-part of application Ser. No. 06/669,202 filed Jan. 24, 1985, now abandoned, which is a continuation-in-part of application Ser. No. 06/615,183 filed May 30, 1984 and now abandoned.

THE TECHNICAL FIELD

This invention relates to asphalt roofing products, often referred to as prepared roofing or composition roofing, and to a method of producing the same. Conventionally, such products are made into strip shingles, for use over sloped roof decks, or rolled goods, for use over relatively flat decks. In the manufacture of both types of products, preformed carrier web, normally fibrous in nature, is coated or impregnated with asphalt and an exposed layer of mineral roofing granules is embedded in the asphalt to improve the weathering capability of the roofing product. Aesthetic features are provided by the coloring of the granules and, in the case of strip shingles, also by the shape and thickness of the exposed portions of the shingles.

BACKGROUND OF THE PRIOR ART

Asphalt shingles and roll roofing have been produced in the same general manner for many years. The industry initially used an organic fibrous mat or an asbestos fiber mat as the preformed carrier. Mats of this type contributed significantly to the strength and flexibility of the finished product. Normally they were saturated with unfilled asphalt for waterproofing purposes, then coated with a thickness of filled asphalt in which a layer of roofing granules subsequently was embedded. The asphalt layer acted as a further waterproofing layer and held the granules in place. The granules and the fillers in the asphalt layer also protected the asphalt against the deleterious action of ultraviolet rays.

Later, the industry began moving more to the use of fiberglass mats instead of the conventional organic fibrous mats or asbestos fiber mats. Because fiberglass mats are much more porous than the previously used mats, this change eliminated the need for asphalt saturant. Instead, filled asphalt previously used only for the coating layer was now used both to impregnate and to coat the mat. Thus the properties of the filled asphalt became more critical. In addition to its waterproofing and weather resistant characteristics, the filled asphalt had to contribute more to the strength of the product, providing stability against deformation at roof temperatures and withstanding stresses encountered in the manufacturing process. Also, it had to adequately resist stresses due to handling by workmen and encountered by enviromental conditions such as wind loading and thermal stresses.

The filler which has been used by the industry is mineral in nature comprised, for example, of ground limestone, silica, slate, trap rock fines, and the like, and is present in the asphalt in substantial amounts. Typically, the filler used in these conventional roofing products has a specific gravity of between about 2.5 and about 3, which is several times more dense than the asphalt which it extends or displaces (the specific gravity of asphalt is about 1.0). Thus a filler content of about 60% by weight yields a filled asphalt having a specific gravity of about 1.7.

As the fibrous mat amounts to a very minor percentage of the total weight of the complete roofing element, a substantial portion, about 55%, excluding the weight of any roofing granule coverage, is comprised of this mineral filler.

The demand for fiber glass based asphalt roofing products has increased greatly since they were first introduced, to the point where they are now the standard product in the industry. During that time, however, their physical characteristics have remained substantially the same while their cost has risen with the rise in costs of their component elements. While it would of course be desirable to produce roofing products of at least as high quality at a lower cost, it is apparent that this goal has not been attained to any significant degree. The length of time that has passed since the introduction of fiber glass based asphalt roofing products is indicative that the problems which must be overcome in order to achieve this goal are considerable.

In looking for a way to improve the product through redesign, the base mat is not a likely element to change since the fiber glass mats conventionally used are quite low in weight already and are not likely to be replaced by a less expensive material without sacrificing desirable properties. As to the coating layer, the filled asphalt cannot be reduced in amount without sacrificing aesthetic properties or running the risk of poorer performance. A relatively thick layer of filled asphalt is desired in roofing shingles in order to provide a thick butt portion, which is considered aesthetically pleasing due to the shadow line it creates on the roof. Further, if the layer is too thin the roofing granules will not be held in place as securely as in a thicker layer.

Because asphalt is more expensive than the conventional filler material, the use of less asphalt overall, without reducing the amount of filler, has been tried by others. The result has been a cheaper roofing product, but one which cannot weather to the same level as a product with more of the same quality asphalt. Further, a significant reduction in asphalt can create processing problems. The more the amount of asphalt in a given mix is reduced, the higher the concentration of filler in the mix. This increases the viscosity of the mix and could cause flow problems through the processing equipment. One way to combat this is to heat the asphalt or the filler or both, since the addition of heat will lower the viscosity. The addition of heat over and above the standard processing temperatures, however, would move the temperature of the asphalt closer to its flashpoint.

The filler itself cannot be reduced to any economically significant extent because of the part it plays in all the various relationships with the asphalt. For example, it must be present in amounts sufficient to provide stability against deformation at high roof temperatures and to decrease degradation from ultraviolet rays.

Against this background it did not appear possible to redesign asphalt roofing products so as to retain all the beneficial performance characteristics of the standard design while at the same time significantly reducing costs. Surprisingly, the present invention achieves this result in a manner which not only satisfies the goal of cost reduction without sacrificing quality, but also provides a number of other benefits.

BRIEF SUMMARY OF THE INVENTION

It has been found that the amount of asphalt used in an asphalt roofing product can be reduced considerably if the specific gravity of the filled asphalt is less than 1.0. The goal would be to reduce this figure to the maximum extent possible, but as a practical matter it appears that the lowest mix specific gravity that could be achieved is about 0.6. A more readily achievable but still highly acceptable range of mix specific gravity is 0.7–0.9.

As previously stated, the less asphalt used the greater the cost reduction, since asphalt can be the single most expensive element in the roofing product. The reason less asphalt can be used in accordance with the present invention has to do with the use of a lightweight filler and the required volumetric relationship of asphalt to filler. In the usual limestone filled product, the irregular surfaces of the filler particles require a relatively large volume of asphalt to cover them adequately in order to hold the mass together. This is true of the other conventional fillers previously mentioned. When fillers are used which have less surface area per unit of volume of an individual filler particle, then less asphalt need be used. The ideal shape of filler particle would therefore be a sphere, and the ideal particle would not be so friable as to break up into smaller pieces when subjected to the rigors of shipping or to the asphalt mixing operation, since this would produce even more volume or surface area for the asphalt to coat and would dictate the use of even more asphalt.

In order to maintain the same thickness of product as is conventionally offered, for reasons of aesthetics and handleability, the volume of filled asphalt would be the same as is conventionally used, although thicker or thinner products could be made if desired. By using a filler that requires less asphalt to achieve that volume, the amount of asphalt used is reduced. Therefore, the ideal situation would be to use a mix having a very low specific gravity and being heavily loaded with a lightweight, relatively inexpensive filler. This would yield a number of benefits in addition to cost reduction flowing from material costs. Since the roofing material would be substantially reduced in weight, each package could contain more roofing material, thereby reducing the amount of packaging paper used. More products could be shipped in a truckload, thus reducing shipping costs. Application of the material to a roof would be faster because workmen could handle it more easily, and the roofing material would not produce such heavy roof loading, thereby allowing the roof support structure itself to be more economically designed. Other advantages will become apparent in the more detailed description of the invention which follows.

DETAILED DESCRIPTION OF THE INVENTION

Figure 1:
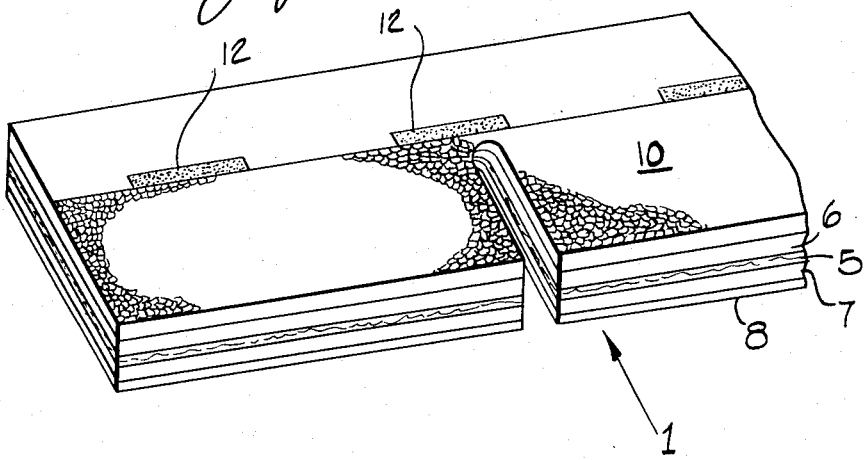
FIG. 1 is a perspective view of a portion of a three tab composition shingle which can be made in accordance with the present invention.

FIG. 1 shows a portion of a tab strip shingle which can be made in accordance with the present invention. Except for the composition of specific portions of this shingle and the resulting physical characteristics, the overall shingle construction is identical with that of typical prior art strip shingles. The overall construction of the shingle 1 is in the form of a flexible laminate which includes a preformed web 5, preferably an open mesh nonwoven fibrous mat. Such a mat is readily available in the industry and typically is formed of randomly felted glass fibers bonded together with a polymer adhesive material. The resulting mat is impregnated and coated with a layer of asphalt based material 6 on the upper surface thereof. The lower surface of felt 5 conventionally is also coated with a thinner layer of asphalt based material as shown by layer 7. Since these composite shingles are normally shipped one against the other in bundles, a parting layer 8 is adhered to the lowermost surface of layer 7 to prevent each shingle from adhering to the next shingle, a phenomenon referred to in the trade as blocking. The parting layer typically comprises talc or some other material that can be adhered to the layer 7 during manufacture when the asphalt is soft and tacky.

The upper surface of the sinlge, or at least that portion of the upper surface which would be exposed to the elements of the weather, is covered with a weatherable surfacing material 10 which is commonly comprised of mineral roofing granules. Along the upper edge of the exposed portion of the granule layer 10 are a series of adhesive stripes 12. These stripes function to hold down the tabs or butt portion of the overlying shingle when the strip shingles are applied to a roof in conventional overlapping fashion. The stripes 12 prevent the wind from lifting the shingles, which would thus weaken or destroy the weatherproof character of the shingled roof. The adhesive stripes 12 can be composed of any suitable adhesive designed for use in this environment, but preferably are composed of a contact adhesive or a combination of contact and heat sensitive adhesive material such as set forth in U.S. Pat. No. 3,138,897, which patent is incorporated herein by reference.

As stated above, the basic construction of the shingle of FIG. 1 can be of conventional design. Critical to the invention, however, is the particular composition of the filled asphalt which impregnates the mat 5 and forms coating layer 6. Specifically, rather than the conventional limestone filler material, the filled asphalt includes, preferably but not necessarily to the exclusion of such relatively dense particulate materials, a low density filler material. Such filler material in accordance with the present invention may be from several sources, for example, heat expanded perlite, heat expanded pumicite, and glass, ceramic or expanded clay microspheres or microbubbles. Examples of materials which, if they meet the requirements set forth in greater detail below, would be adequate for the present invention are disclosed in U.S. Pat. Nos. 3,365,315 and 2,676,892. These patents respectively disclose a method of making glass bubbles or microspheres and a method of making unicellular spherulized clay particles and the material made by these processes. However, as will be explained, the preferred material is heat expanded perlite or heat expanded pumicite, the latter also being known as volcanic ash.

Whatever the source of lightweight particulate mineral filler, it has been found that the filler should be of such nature that the specific gravity of the filled asphalt mix should in any event be less than 1.0 and preferably in the range of 0.6–0.9. To accomplish this, it has further been found that the filler should have an effective specific gravity in the range of 0.10 to 0.50. For reasons of cost effectiveness, however, it is preferred that the effective specific gravity of the filler be in the range of 0.20 to 0.40. The effective specific gravity of a filler material is not necessarily the same as the specific gravity calculated from its bulk density. Due to breakage in processing, its shape, its wetting characteristics and other relationships, the actual effect of the filler on the specific gravity of a mix is a function of all such variables and can best be expressed in terms of its effective specific gravity, which in turn is a function of the specific gravity of the mix, the specific gravity of the asphalt, and the amounts of filler and asphalt present in the mix. More particularly, this relationship can be expressed by the equation:

$$\text{Filler Eff. } S.G. = \frac{\text{Mix } S.G. \text{ (wt. \% filler)}}{1 - \text{(wt. \% asphalt)(mix } S.G./\text{asph. } S.G.)}$$

where the weight percent values are expressed in decimals, e.g., 50% would be expressed as 0.50. As an example, to clarify the equation, assume that the mix specific gravity is 0.8, the specific gravity of the asphalt is 1.0, the amount of filler in the mix is 15% by weight and the amount of asphalt in the mix is 85% by weight. This would be shown in the equation as follows:

$$\text{Filler Eff. } S.G. = \frac{0.8\ (.15)}{1 - (.85)(0.8/1)} = 0.375$$

It should be understood that the term "effective specific gravity", when used in the specification and claims herein, shall have the definition assigned to it in the foregoing explanation.

The lower limit of 0.10 effective specific gravity of the filler material is attainable through use of the materials utilized in the present invention, but cannot be practically further reduced since this figure is already approaching the effective specific gravity of air.

Although the weight percent of filler present in the mix is a function of its effective specific gravity and its actual bulk density, and as such will vary with each particular filler contemplated for use, taking into account its effect on mix viscosity, a range of 3% to 25% by weight has been found to apply to all satisfactory fillers tested to date, with a range of 5% to 20% by weight being preferred.

Whatever the source of the lightweight filler material, the resulting filled asphalt based coating should process in a manner as close as possible to that of conventionally filled asphalt, that is, the coating should be in a liquid flowable form, should penetrate or adhere to the mat 5, should continue to adhere the granule layer 10 or the parting layer 8 to the surfaces thereof and should have equivalent or superior weathering ability. In short, the ideal lightweight filled asphalt based coating should, in addition to having a lower specific gravity and in addition to other benefits it may supply, have all of the beneficial performance characteristics of the prior art filled asphalt coating material.

In order for the coating of the present invention to process in the manner of prior art filled asphalt coating compositions and be stable in its molten state, it has been found that at least about 84% by weight of the particles making up the lightweight filler should pass through a standard 64 mesh sieve and at least 25% by weight should pass through a 200 mesh sieve. It has been found that when a filled composition incorporating a lightweight mineral filler composed of particles substantially larger than that disclosed above is coated onto a conventional fiber glass mat, the mat itself tends to filter out these larger particles, resulting in localized portions of the asphalt coating containing substantially less filler and portions containing substantially more filler than optimum. Such segregation on the mat is undesirable since the resulting unfilled asphalt portion may melt and run under certain conditions, in contrast with a properly filled asphalt.

In a preferred embodiment of this invention, the filled asphalt coating comprises a mineral filler which is an expanded perlite or expanded pumicite filler. This filler is made by thermally expanding the raw graded ore in a manner set forth in more detail below.

Preferred perlite materials are those particles known as ultrafines, which are the undersized ore particles (less than 30 microns) left in the bag house of conventional perlite ore operations. Using expansion techniques as set forth below, this undersized raw perlite aggregate (which has the consistency of a fine face powder) is expanded to form a lightweight filler having a bulk density of about 3 to 15 pcf. These extremely fine expanded particles have the requisite degree of fineness, and the great bulk of them constitute or include gas filled voids or inclusions.

Pumicite ore, or volcanic ash as mentioned above, may also be used. These ore particles are even smaller than ultrafine perlite ore particles, typically being in the range of 100 microns. It should be realized that other fillers can be used so long as the mix parameters discussed above are met.

As to the asphalt matrix, it is preferred that a conventional roofing or coating grade asphalt be used. Other asphalts are also contemplated, however.

By way of example, a typical prior art shingle, marketed under the trademark FIREGLASS III of Manville Corporation, has a nominal weight of between 205 and 210 lb. per square, where a square of roofing material is the amount used to cover 100 square feet of roof surface. This weight includes about 70 lb. of limestone filler. Using filler techniques in accordance with the present invention, a lightweight filler, specifically an expanded perlite having a bulk density of about 9 pcf and a particle size distribution as set forth above, was used at the rate of about 7 lb. per square as a substitute for the limestone filler. The resulting shingle had a nominal weight of about 150 lb. per square. This shingle had the same thickness as a standard shingle. The thus filled asphalt had a specific gravity of about 0.8 and a nominal weight of only 155 lb. per square. The expanded perlite had an effective specific gravity of 0.44 and was present in the mix in the amount of 20% by weight. This filled asphalt had weathering characteristics and granule retention capabilities at least as good as the conventional filled asphalt, and had potentially superior crack resistance and cold weather handleability.

A typical bundle of the prior art shingle weighs about 70–80 lb. and, using conventional lay-up techniques, covers about 33 sq. ft. of roof area. Because of the weight savings, a 75 lb. bundle of the shingle of the present invention would cover about 50 sq. ft. of roof area using the same application technique. This same weight saving phenomenon also results in more efficient shipping of the shingle bundles. A typical truck load of the shingles of the present invention would contain up to an additional 100 squares of shingles for the same gross weight.

A similar roofing element was constructed using a commercial lightweight filler, a heat expanded perlite product having a bulk density of about 10 pcf, with about 80% by weight passing through a standard 200 mesh screen. Its effective specific gravity was 0.38 and it was present in the mix in the amount of 17% by weight. The specific gravity of the mix was 0.79. A three-tab shingle made from the element had product characteristics similar to the perlite filled asphalt shingle described above.

In another example dried, screened pumicite ore in the form of a fine powder was fed to an expander in the manner set forth below in more detail. This material expanded to a bulk density of about 3.0 pcf and had an effective specific gravity of 0.29. About 84% of this material passed a standard 64 mesh screen, about 48% passed a 100 mesh screen and about 35% passed a 200 mesh screen. The thus expanded pumicite filler was added to conventional molten coating grade asphalt until about 50% of the total volume of the filled coating was pumicite filler and about 12% of the total weight was expanded pumicite. This material had a mix specific gravity of 0.76 and had viscosity characteristics similar to that of conventional limestone or trap rock filled asphalt. Also, like the conventional asphalts, this material could be processed into roofing elements using generally conventional manufacturing equipment. However, unlike conventional filled coatings,. only about 12% of the total coating weight was attributable to the filler, as opposed to about 64% for conventional fillers.

This material was coated onto both sides of a conventional glass fiber roofing mat and subsequently converted into a number of roofing products. For example, a mineral surfaced roll roofing product was produced which was identical in every obvious respect to its conventional counterpart except that it weighed 55 to 58 pounds per square compared to 72 pounds per square for the conventional product. In another example, a product was made similar to the laminated composition shingle marketed under the trademark WOODLANDS, a trademark of Manville Corporation, which normally has a weight of only 185 pounds per square. Also, a product substantially identical to the FIREGLASS III shingle mentioned previously was made having a nominal weight of only 145 pounds per square.

In a further test a different sample of pumicite ore was expanded to a bulk density of only 1.5 pcf and seemed to have similar asphalt filling characteristics, resulting in a mix specific gravity of 0.8 at a weight loading of 3 to 5% to provide equivalent volume loading and flow characteristics.

Figure 2:
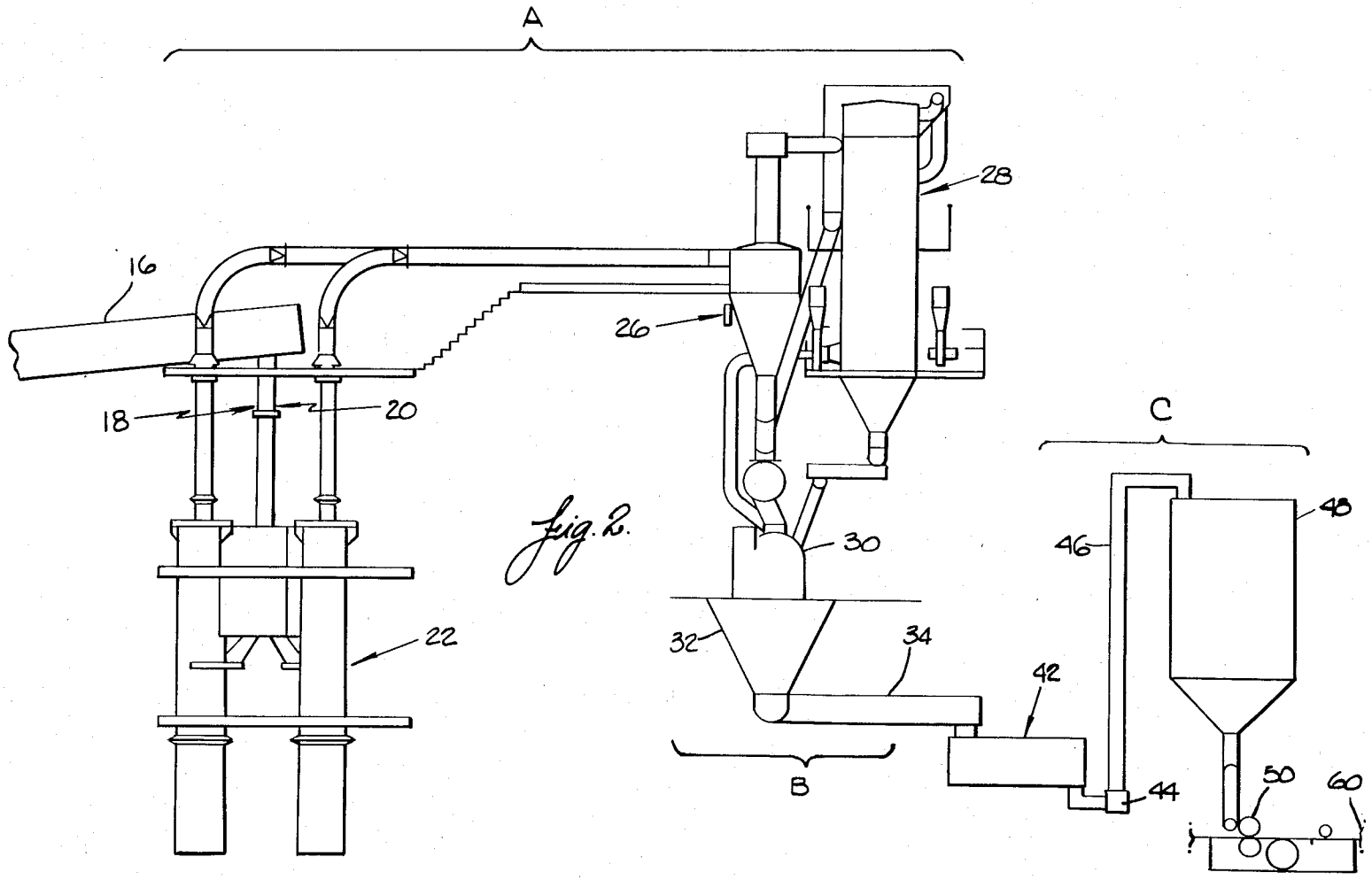
FIG. 2 is a schematic view of apparatus used to make composition roofing material in accordance with the present invention.

FIG. 2 shows in schematic form an apparatus for producing large quantities of roofing material in accordance with the present invention, wherein the asphalt mix contains a filler which is produced by expanding ore such as perlite or pumicite ore.

The overall apparatus is divided into three main functional sections. Section A, known as the expansion section, includes apparatus to convey and thermally expand the ore and to separate the thus expanded ore from the hot gases from the expander.

Section B is a coating section. Here the expanded lightweight filler material is coated when necessary with a coating material to make the expanded filler more compatible with the molten asphalt.

Section C is where the expanded lightweight mineral filler, coated or uncoated, is mixed with the molten asphalt for application using conventional techniques to the web or mat.

Starting with Section A in more detail, the ore or other unprocessed mineral material, in the form of small particles, is delivered using a conventional screw or belt conveyor to an ore feed chute 18. Here the ore is selectively delivered using a diverter valve 20 to one or more expanders 22. The expanders 22 may be of conventional design but should preferably be modified by using conventional techniques in order to expand ore of less than 400 mesh. Such modifications may include the incorporation of a so-called fountain-feed method of delivering extremely fine particulate material to the expansion chamber, precise control of the velocities of combustion gases through the expansion chamber itself, and gas separation devices (herein shown as cyclone separators 26) to separate the extremely light and fine expanded mineral filler from its entraining airstream. U.S. Pat. No. 4,347,155 shows an energy efficient perlite expansion process and apparatus in great detail which would be useful in producing lightweight filler of the type which could be used in carrying out this invention. This patent is incorporated hereon by reference.

Bag houses 28 are also provided, these having proper capacity to separate out the extremely fine lightweight filler material from the exhaust air. These fines are sent to the coating Section B, as is the output of the cyclones 26.

The coating Section B includes a diverter valve which permits lightweight filler to pass directly to use bin 32. When a coating is necessary the materials pass through coater 30, which may be a fluidizing type mixer which uses spade-like paddles to gently agitate and aerate the lightweight filler, while atomizing nozzles, not shown, spray the thus agitated and aerated filler with appropriate coating materials.

The filler material, coated or uncoated, passes from the use bin 32 via conveyor 34 to an asphalt filler mixer 42. The asphalt filler mixer is of a conventional type. Except for its relative fragility and light weight, the expanded lightweight filler is of such screen size and/or has been surface treated to function in the process equipment similar to conventional limestone or trap rock fillers. From the asphalt filler mixer the thus mixed and filled asphalt coating material passes via transfer pump 44 and transfer line 46 to the use tank 48.

The filled molten asphalt mix flows onto the upper surface of a moving web of a porous, nonwoven fiberglass mat. The filled asphalt is distributed over both sides of the web preferably by rollers 50 and sent on as a coated web 60 to a conventional roofing manufacturing facility while the asphalt is still in a fluid condition.

As stated earlier, this basic coated web 60 may be converted into different materials. Roll roofing basically is comprised of the coated roofing mat but including also one or more layers of aggregate material to prevent cooled and coated mat from sticking to itself in the roll. In the case of mineral faced roll roofing, it is provided with a coating of roofing granules. Alternatively, strip shingles may be formed from the material. An example of apparatus which would take the coated mat and convert it to roofing shingles is disclosed in U.S. Pat. No. 4,233,100, which patent is incorporated herein by reference. Shown in that patent is a system for converting a continuous web of coated roofing mat to laminated shingles such as that shown in FIG. 3. Of course a similar apparatus could be used to make conventional non-laminated strip shingles having multiple tab butt edges, etc.

Figure 3:
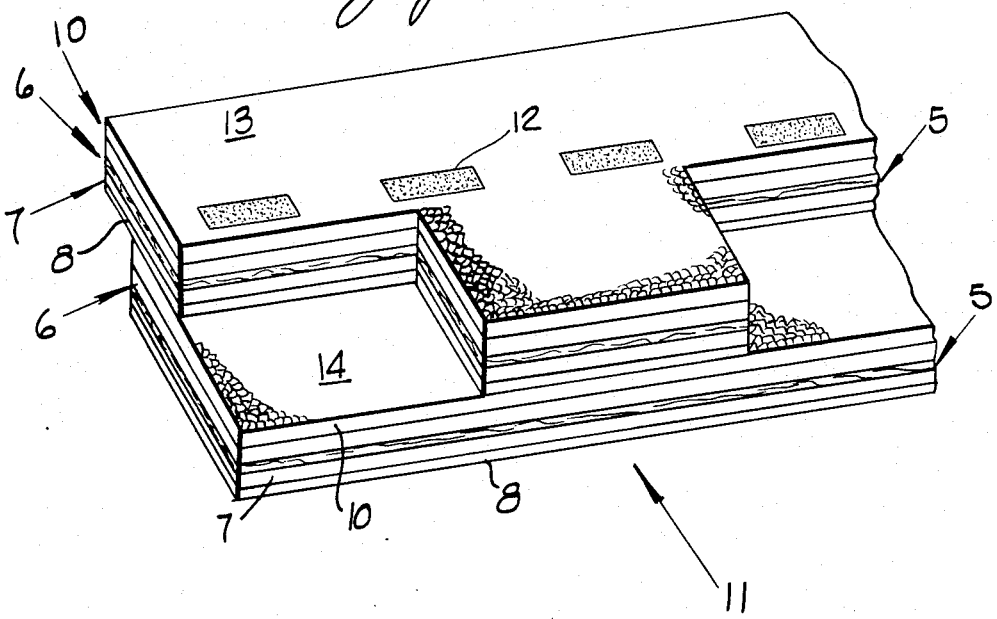
FIG. 3 is a perspective view of a portion of a laminated composition shingle which can be made in accordance with the present invention.

FIG. 3 shows a portion of a typical laminated shingle 11 which can be made using the filled asphalt coating of the present invention. As in FIG. 1, layers 5 show the nonwoven mat which forms the bases of this construction. On the upper surface of each mat 5 is a continuous layer or coating 6 of the lightweight mineral filled asphalt material, and on the lower surface of each is another continuous coating of the mineral filled asphalt. Again, as in FIG. 1, the lower surface of each of these laminates is provided with a layer 8 of a release or parting agent. The distinctive difference between the shingle in FIG. 3 and that shown in FIG. 1 is that it comprises two portions, the overlay portion 13 and the underlay portion 14, laminated together to selectively increase the thickness, at least in the butt portion of the shingle when it is placed in overlapping courses on a roof. As in FIG. 1 the upper surface of each of these laminates is covered with a roofing granule layer 10 or other layer of ultraviolet and weather resistant material.

Although the aesthetic advantage of a laminated shingle is provided, namely the multiple thickness butt edge portions which aid in presenting an aesthetically pleasing roof construction, the heavy limestone filler normally used in the asphalt layers 6 and 7 has been eliminated. The conventional laminated shingle has necessitated about 150 to 200 pounds of filled asphalt coating material per square of roofing, with an overall weight of the roofing product of about 290–300 pounds per square. The laminated shingle 10 made in accordance with the present invention results in only about 75 to 100 pounds of the lightweight filled asphalt coating per square of roofing for an overall product weight of between about 200 to 225 pounds per square.

Modified asphalts or bitumens are also contemplated by the present invention. In these materials, asphalts, known as fluxes, are combined with elastomers, polymers, etc., to alter the characteristics of the asphalts, such as the softening point, penetration, and other physical properties, to impact to the asphalt properties of elongation and to heighten its crack resistance.

While the invention is most often described above in terms of the reduction in the weight of a roof covering or element needed to cover a unit of roof area, the benefits can also be reaped by utilizing the low density filler and asphalt combination to increase the thickness of the roofing element. This is especially desirable when the roofing element is a shingle. As stated above, the thickness or perceived thickness of the butt edge of the shingle provides a certain aesthetic function. If the same weight of shingles can be placed on a roof and yet provide greater aesthetic appeal, this may also be a desirable utilization of the invention.

Also, it is contemplated that a mixture of conventional fillers and lightweight fillers, if the resulting coating has parameters in the required range, would also fall within the teachings of the present invention.

Further, whenever the word pumicite is used herein, whether in the specification or claims, it is to be understood that it is intended to mean volcanic ash as well.

What is claimed is:

1. A flexible composite roofing element, comprising:
a preformed flexible web; and
a filled asphalt-based coating adhered to said web, said coating comprising asphalt and particulate filler distributed throughout the asphalt, the specific gravity of the coating being less than 1.0 and the filler having an effective specific gravity in the approximate range of 0.10–0.50;
the filler comprising particles having hollow, gas filled inclusions.

2. A roofing element according to claim 1, wherein the filler is present in amount in the approximate range of 3%–25% by weight of the filled coating.

3. A roofing element according to claim 1, wherein at least about 25% of the filler is capable of passing through a standard 200 mesh screen.

4. A roofing element, comprising:
a fibrous mat comprised of glass fibers;
asphalt-based coating material impregnating and coating the fibrous mat;
the coating material containing lightweight filler particles having hollow, gas filled inclusions distributed throughout and being present in amount in the approximate range of 3%–25% by weight of the coating material, the specific gravity of the coating material being in the range of about 0.6–0.9;
the effective specific gravity of the filler particles being in the range of about 0.10–0.50; and
at least about 25% of the filler particles being capable of passing through a standard 200 mesh screen.

5. A roofing element according to claim 4, wherein the effective specific gravity of the filler particles is in the range of about 0.20–0.40.

6. A roofing element according to claim 4, wherein at least about 84% of the filler particles are capable of passing through a standard 64 mesh screen.

7. A roofing element according to claim 4, wherein the filler particles have a bulk density of not more than about 3 pcf.

8. A roofing element according to claim 4, wherein the filler particles have a bulk density between 1.5–3 pcf.

9. A roofing element according to claim 8, wherein the particles comprise expanded perlite particles.

10. A roofing element according to claim 8, wherein the particles comprise expanded pumicite particles.

11. A roofing element according to claim 8, including additionally a layer of mineral granules on at least one surface of the coated fibrous mat.

12. A process for making asphalt roofing products, comprising the steps of:
providing lightweight particles having hollow, gas filled inclusions of a size whereby at least about 25% thereof are capable of passing through a standard 200 mesh screen and whereby the effective specific gravity of the particles is in the approximate range of 0.10–0.50;
mixing the particles with fluid asphalt to form a mixture having a specific gravity less than 1.0;
impregnating and coating a fibrous mat with the mixture; and
cooling the mixture.

13. A process according to claim 12, wherein the particles are present in the mixture in the amount of about 3%–25% by weight of the mixture.

14. A process according to claim 13, wherein the lightweight particles are provided by expanding heat expandable ore to produce particles having hollow, gas filled inclusions.

15. A process according to claim 14, wherein the ore is perlite ore.

16. A process according to claim 14, wherein the ore is pumicite ore.

17. A process according to claim 12, including the additional steps of applying a layer of roofing granules to the coating prior to the cooling step, then cutting the cooled and granule coated material to a predetermined shape.

18. A process according to claim 13, wherein at least about 84% of the particles are capable of passing through a standard 64 mesh screen.

19. A process according to claim 12, wherein the specific gravity of the mixture is about 0.6–0.9, the effective specific gravity of the filler particles is in the approximate range of 0.20–0.40, and the filler is present in the mixture in the amount of about 5%–20% by weight of the mixture.

* * * * *